US010013910B2

(12) United States Patent
Park

(10) Patent No.: US 10,013,910 B2
(45) Date of Patent: Jul. 3, 2018

(54) ELECTRONIC DEVICE CONFIGURED TO OPERATE IN A NORMAL MODE AND A LOW POWER MODE

(71) Applicant: Samsung Display Co., Ltd, Yongin-si, Gyeonggi-do (KR)

(72) Inventor: Sung-Un Park, Suwon-si (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/459,413

(22) Filed: Mar. 15, 2017

(65) Prior Publication Data

US 2018/0090051 A1 Mar. 29, 2018

(30) Foreign Application Priority Data

Sep. 27, 2016 (KR) ..... 10-2016-0123752

(51) Int. Cl.
*G09G 3/20* (2006.01)
*G09G 5/10* (2006.01)

(52) U.S. Cl.
CPC ..... *G09G 3/2092* (2013.01); *G09G 3/2003* (2013.01); *G09G 5/10* (2013.01); *G09G 2330/021* (2013.01); *G09G 2340/06* (2013.01); *G09G 2360/08* (2013.01)

(58) Field of Classification Search
None
See application file for complete search history.

(56) References Cited

U.S. PATENT DOCUMENTS

| | | | | |
|---|---|---|---|---|
| 8,884,857 | B2 | 11/2014 | Munteanu et al. | |
| 9,250,695 | B2 | 2/2016 | Tse | |
| 2009/0040234 | A1* | 2/2009 | Kobayashi | G09G 5/02 345/604 |
| 2009/0185078 | A1* | 7/2009 | Van Beek | G06T 3/4007 348/624 |
| 2013/0010017 | A1* | 1/2013 | Kobayashi | G09G 3/3648 345/690 |

FOREIGN PATENT DOCUMENTS

KR 1020150099216 A 8/2015

* cited by examiner

*Primary Examiner* — Joni Richer
(74) *Attorney, Agent, or Firm* — Innovation Counsel LLP

(57) ABSTRACT

An electronic device includes a host device configured to provide a display device with first image data having a first number of bits per pixel in a normal mode, and to convert the first image data into second image data having a second number of bits per pixel less than the first number of bits per pixel to provide the display device with the second image data in a low power mode. The display device is configured to display a first image based on the first image data in the normal mode, and to convert the second image data into third image data to display a second image based on the third image data in the low power mode.

17 Claims, 9 Drawing Sheets

AT NORMAL MODE

AT LOW POWER MODE

AT NORMAL MODE

AT LOW POWER MODE

ELECTRONIC DEVICE CONFIGURED TO OPERATE IN A NORMAL MODE AND A LOW POWER MODE

CROSS-REFERENCE TO RELATED APPLICATION(S)

This application claims priority under 35 USC § 119 to Korean Patent Application No. 10-2016-0123752, filed on Sep. 27, 2016 in the Korean Intellectual Property Office (KIPO), the contents of which are incorporated herein in its entirety by reference.

BACKGROUND

1. Technical Field

Exemplary embodiments of the present inventive concept relate to electronic devices, and more particularly, to electronic devices capable of reducing interface power consumptions in low power modes and methods of operating the electronic devices.

2. Description of the Related Art

Recently, an electronic device is requested to support a low power mode to reduce power consumption. In particular, in a portable electronic device, such as a smart phone, the low power mode is highly required to be used as long as possible even if a charge amount of a battery is small. To meet these requirements, an ultra low power saving (ULPS) mode has been developed as the low power mode of the portable electronic device. In the ULPS mode, the portable electronic device may perform only basic functions, such as a phone call, a text, or an internet, and/or only limited applications, such as a memo application, a messenger application, or the like so as to reduce the power consumption of the portable electronic device. However, it is more desirable to further reduce the power consumption in the low power mode, such as the ULPS mode.

SUMMARY

Some example embodiments provide an electronic device capable of reducing interface power consumption between a host device and a display device in a low power mode.

Some example embodiments provide a method of operating an electronic device capable of reducing interface power consumption between a host device and a display device in a low power mode.

According to example embodiments, there is provided an electronic device including a host device configured to provide a display device with first image data having a first number of bits per pixel in a normal mode, and to convert the first image data into second image data having a second number of bits per pixel less than the first number of bits per pixel to provide the display device with the second image data in a low power mode, and the display device configured to display a first image based on the first image data in the normal mode, and to convert the second image data into third image data to display a second image based on the third image data in the low power mode.

In example embodiments, the host device may include a first data converting block configured to bypass the first image data in the normal mode, and to convert the first image data into the second image data in the low power mode.

In example embodiments, the first data converting block may convert RGB data as the first image data into luminance data as the second image data in the low power mode.

In example embodiments, the first data converting block may convert the RGB data into the luminance data using an equation "Y=0.25*R+0.5*G+0.25*B", where Y represents a value of the luminance data, R represents a value of red sub-pixel data of the RGB data, G represents a value of green sub-pixel data of the RGB data, and B represents a value of blue sub-pixel data of the RGB data.

In example embodiments, the second number of bits per pixel of the second image data may be one third of the first number of bits per pixel of the first image data.

In example embodiments, the display device may include a second data converting block configured to bypass the first image data in the normal mode, and to convert the second image data into the third image data in the low power mode.

In example embodiments, the second data converting block may convert luminance data as the second image data into black-and-white data as the third image data in the low power mode.

In example embodiments, the black-and-white data may include red sub-pixel data, green sub-pixel data and blue sub-pixel data each having a value the same as a value of the luminance data with respect to each pixel.

In example embodiments, the display device may display a color image as the first image in the normal mode, and may display a black-and-white image as the second image in the low power mode.

In example embodiments, the electronic device may further include a plurality of data lanes located between the host device and the display device, the plurality of data lanes being used to transfer the first image data and the second image data.

In example embodiments, the first image data may be transferred through the plurality of data lanes in the normal mode, and the second image data may be transferred through a portion of the plurality of data lanes in the low power mode.

In example embodiments, supplying power to a remaining portion of the plurality of data lanes through which the second image data are not transferred may be stopped during the low power mode.

In example embodiments, the first image data may be transferred from the host device to the display device using a dual display serial interface in the normal mode, and the second image data may be transferred from the host device to the display device using a single display serial interface in the low power mode.

According to example embodiments, there is provided an electronic device including a host device configured to provide a display device with RGB data having a first number of bits per pixel in a normal mode, and to convert the RGB data into luminance data having a second number of bits per pixel less than the first number of bits per pixel to provide the display device with the luminance data in a low power mode, and the display device configured to display a color image based on the RGB data in the normal mode, and to convert the luminance data into black-and-white data to display a black-and-white image based on the black-and-white data in the low power mode.

According to example embodiments, there is provided a method of operating an electronic device including a host device and a display device. In the method, the host device provides the display device with first image data having a first number of bits per pixel in a normal mode. The host device provides the display device with second image data having a second number of bits per pixel less than the first number of bits per pixel in a low power mode by converting the first image data into the second image data. The display device displays a first image based on the first image data in the normal mode, and the display device displays a second image based on third image data in the low power mode by converting the second image data into the third image data.

In example embodiments, the first image data may be RGB data, and the second image data may be luminance data.

In example embodiments, the second number of bits per pixel of the second image data may be one third of the first number of bits per pixel of the first image data.

In example embodiments, the third image data may be black-and-white data including red sub-pixel data, green sub-pixel data and blue sub-pixel data each having a value the same as a value of the second image data with respect to each pixel.

In example embodiments, the first image may be a color image, and the second image may be a black-and-white image.

In example embodiments, the first image data may be transferred through a plurality of data lanes between the host device and the display device in the normal mode, and the second image data may be transferred through a portion of the plurality of data lanes in the low power mode.

As described above, in the electronic device and the method of operating the electronic device according to example embodiments, the host device may transfer, in the low power mode, the second image data having the number of bits per pixel less than the number of bits per pixel of the first image data transferred in the normal mode to the display device, and thus the interface power consumption between the host device and the display device in the low power mode may be reduced.

Further, in the electronic device and the method of operating the electronic device according to example embodiments, the image data may be transferred in the low power mode using a portion of the plurality of data lanes between the host device and the display device, and thus the interface power consumption between the host device and the display device in the low power mode may be further reduced.

BRIEF DESCRIPTION OF THE DRAWINGS

Illustrative, non-limiting example embodiments will be more clearly understood from the following detailed description in conjunction with the accompanying drawings.

DETAILED DESCRIPTION OF THE EMBODIMENTS

Hereinafter, embodiments of the present inventive concept will be explained in detail with reference to the accompanying drawings.

Figure 1:
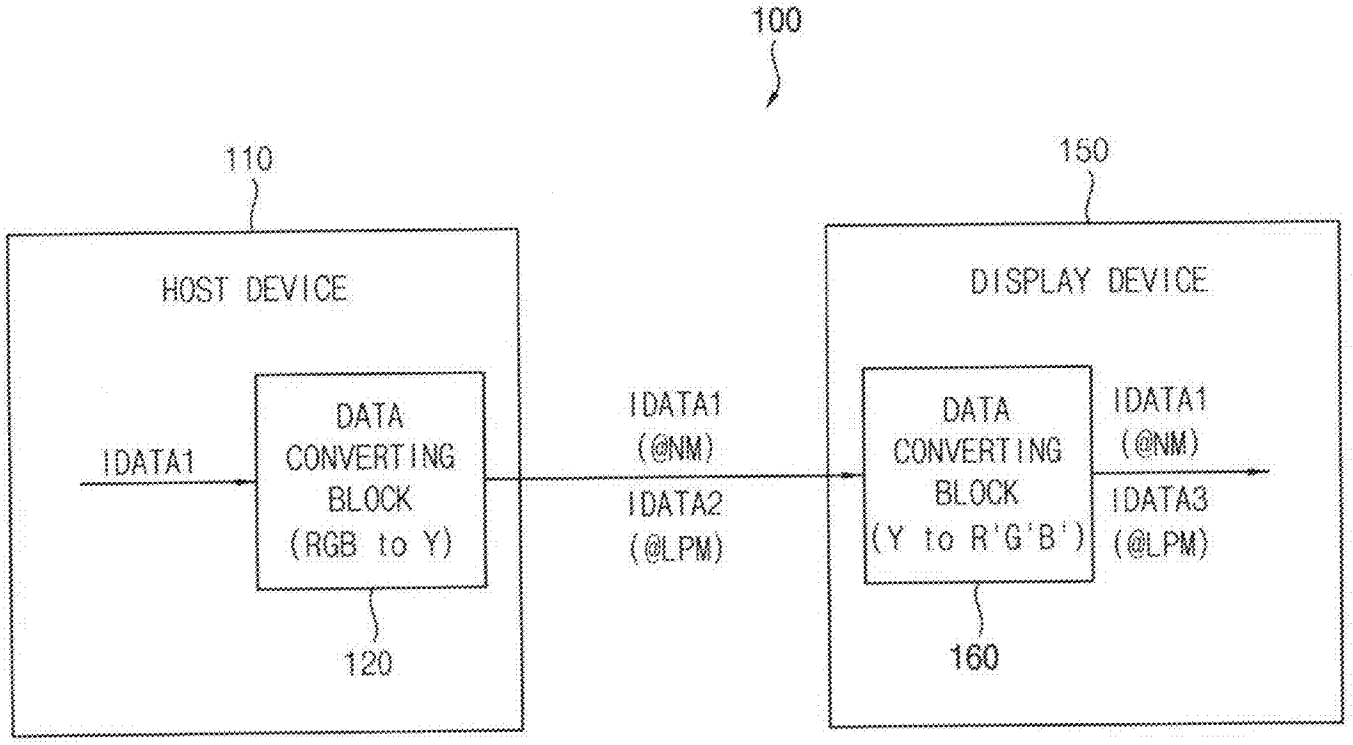
FIG. 1 is a block diagram illustrating an electronic device including a host device and a display device according to example embodiments.

FIG. 1 is a block diagram illustrating an electronic device 100 including a host device 110 and a display device 150 according to example embodiments.

Referring to FIG. 1, the electronic device 100 according to example embodiments includes the host device 110, and the display device 150 connected to the host device 110. In some example embodiments, the electronic device 100 may be a portable electronic device, such as a smart phone, a mobile phone, a tablet computer, etc. In other example embodiments, the electronic device 100 may be any electronic device including the display device 150, such as a digital television (TV), a 3D TV, a personal computer (PC), a home appliance, a laptop computer, a personal digital assistant (PDA), a portable multimedia player (PMP), a digital camera, a music player, a portable game console, a navigation device, etc.

The host device 110 may control an overall operation of the electronic device 100. In some example embodiments, the host device 110 may be an application processor (AP) that controls an operation of the portable electronic device. In other example embodiments, the host device 110 may be a central processing unit (CPU), a graphics processing unit (GPU), a microprocessor, or the like.

The host device 110 may provide the display device 150 with image data through a predetermined interface. In some example embodiments, the interface between the host device 110 and the display device 150 may be a mobile industry processor interface (MIPI). In other example embodiments, the interface between the host device 110 and the display device 150 may be DisplayPort (DP), embedded DisplayPort (eDP), low-voltage differential signaling (LVDS), or any other display interface.

In the electronic device 100 according to example embodiments, the host device 110 may provide the display device 150 with first image data IDATA1 having a first number of bits per pixel in a normal mode NM. In a low power mode LPM, the host device 110 may convert the first image data IDATA1 into second image data IDATA2 having a second number of bits per pixel less than the first number of bits per pixel, and may provide the display device 150 with the second image data IDATA2. Accordingly, a data transfer amount from the host device 110 to the display device 150 in the low power mode LPM may be reduced compared with the data transfer amount in the normal mode NM, and thus interface power consumption between the host device 110 and the display device 150 in the low power mode LPM may be reduced compared with the interface power consumption in the normal mode NM.

In some example embodiments, the host device 110 may include a first data converting block 120 to provide the first image data IDATA1 having the first number of bits per pixel in the normal mode NM and to provide the second image data IDATA2 having the second number of bits per pixel in the low power mode LPM. In the normal mode NM, the first data converting block 120 may receive the first image data IDATA1, and may bypass (or output as it is) the received first image data IDATA1. In the low power mode LPM, the first data converting block 120 may receive the first image data IDATA1, may convert the received first image data IDATA1 into the second image data IDATA2 having the second number of bits per pixel less than the first number of bits per pixel, and output the second image data IDATA2. In some example embodiments, the second number of bits per pixel of the second image data IDATA2 may be one third of the first number of bits per pixel of the first image data IDATA1. For example, in the low power mode LPM, the first data converting block 120 may convert RGB data having 24 bits per pixel as the first image data IDATA1 into luminance data having 8 bits per pixel as the second image data IDATA2. Accordingly, the data transfer amount in the low power mode LPM may be reduced to about one third of the data transfer amount in the normal mode NM, and thus the interface power consumption between the host device 110 and the display device 150 in the low power mode LPM may be reduced to about one third of the interface power consumption between the host device 110 and the display device 150 in the normal mode NM.

The display device 150 may display an image based on image data provided from the host device 110. In some example embodiments, the display device 150 may be an organic light emitting diode (OLED) display device. In other example embodiments, the display device 150 may be a liquid crystal display (LCD) device, a plasma display panel (PDP) device, etc.

In the normal mode NM of the electronic device 100 according to example embodiments, the display device 150 may receive the first image data IDATA1 having the first number of bits per pixel from the host device 110, and may display a first image based on the first image data IDATA1. In some example embodiments, the first image data IDATA1 may be the RGB data, and the first image may be a color image displayed based on the RGB data.

In the low power mode LPM of the electronic device 100 according to example embodiments, the display device 150 may receive the second image data IDATA2 having the second number of bits per pixel from the host device 110, may convert the second image data IDATA2 into third image data IDATA3 having a data format used in the display device 150, and may display a second image based on the third image data IDATA3. In some example embodiments, the second image data IDATA2 that the display device 150 receives in the low power mode LPM may be luminance data, the third image data IDATA3 may be black-and-white data including red sub-pixel data, green sub-pixel data and blue sub-pixel data each having a value the same as a value of the luminance data with respect to each pixel, and the second image may be a black-and-white image displayed based on the black-and-white data.

In some example embodiments, the display device 150 may include a second data converting block 160 to operate based on the first image data IDATA1 in the normal mode NM and to operate based on the third image data IDATA3 by converting the second image data IDATA2 into the third image data IDATA3 in the low power mode LPM. In the normal mode NM, the second data converting block 160 may receive the first image data IDATA1, and may bypass (or output as it is) the received first image data IDATA1. In the low power mode LPM, the second data converting block 160 may receive the second image data IDATA2, may convert the second image data IDATA2 into the third image data IDATA3 having the data format used in the display device 150, and may output the third image data IDATA3. The third image data IDATA3 output from the second data converting block 160 may be input to a timing controller of the display device 150, and the timing controller may control components of the display device 150 to display the second image based on the third image data IDATA3. In some example embodiments, the second image data IDATA2 may be the luminance data, and the third image data IDATA3 may be the black-and-white data including the red, green and blue sub-pixel data each having the value the same as the value of the luminance data with respect to each pixel, and the second image may be the black-and-white image. Here, the luminance data may represent data for a luminance component of the first image (e.g., the color image). For example, the first image data, or the RGB data in an RGB color space may be converted into YCoCg data in an YCoCg color space, and the second image data, or the luminance data may be a Y data of the YCoCg data. Here, the black-and-white data may represent the RGB data having the same value for red, green and blue sub-pixels of each pixel.

In a conventional electronic device, even if a display device displays a black-and-white image in a low power mode, a host device provides the display device with RGB data in the low power mode that are the same as the RGB data in a normal mode, and the display device internally converts the RGB data into black-and-white data to display a black-and-white image in the low power mode. In particular, in the conventional electronic device, the number of bits per pixel of the RGB data transferred from the host device to the display device in the low power mode is the same as the number of bits per pixel of the RGB data transferred from the host device to the display device in the normal mode.

However, as described above, in the electronic device 100 according to example embodiments, the host device 100 may transfer, in the low power mode LPM, the second image data IDATA2 (e.g., the luminance data) having the second number of bits per pixel less than the first number of bits per pixel of the first image data IDATA1 transferred in the normal mode NM to the display device 150. Thus the interface power consumption between the host device 110 and the display device 150 in the low power mode LPM may be reduced.

Figure 2A:
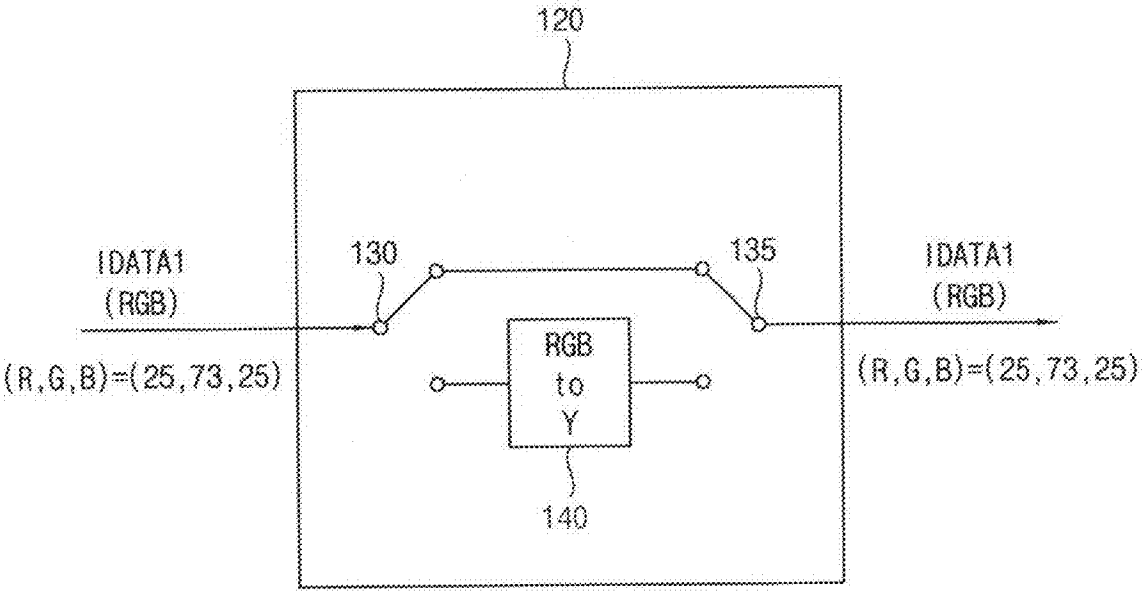
FIG. 2A is a diagram for describing an example of a normal mode operation of a data converting block included in a host device illustrated in FIG. 1.
Figure 2B:
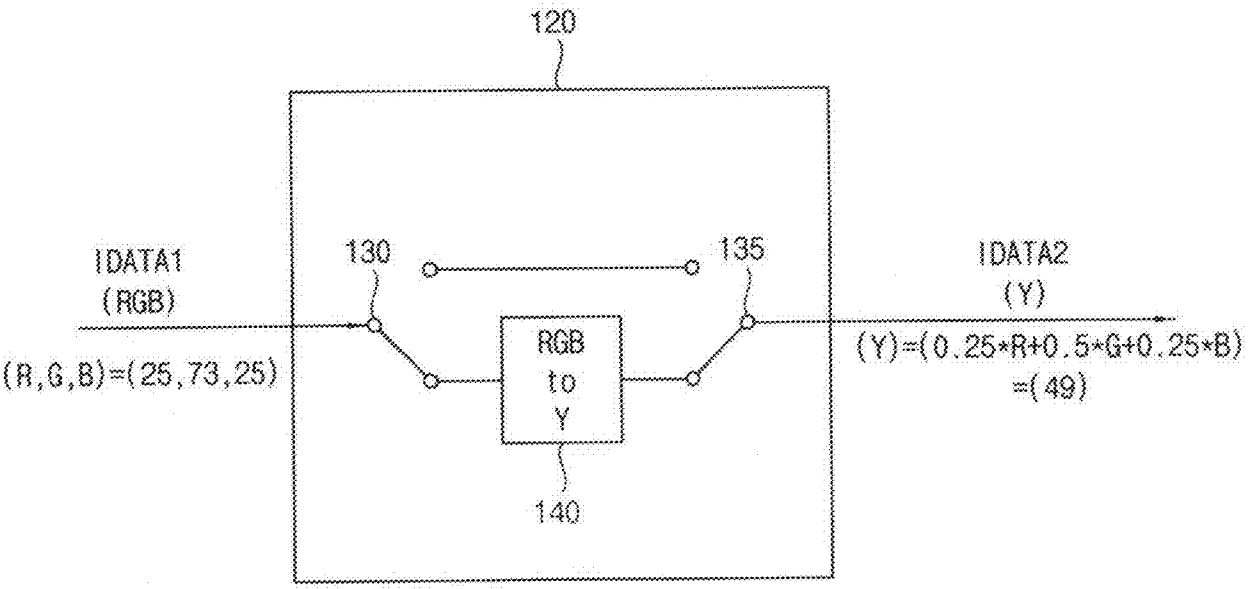
FIG. 2B is a diagram for describing an example of a low power mode operation of a data converting block included in a host device illustrated in FIG. 1.

FIG. 2A is a diagram for describing an example of a normal mode operation of the first data converting block 120 included in a host device 110 illustrated in FIG. 1, and FIG. 2B is a diagram for describing an example of a low power mode operation of the first data converting block 120 included in a host device 110 illustrated in FIG. 1.

Referring to FIG. 2A, the first data converting block 120 included in the host device 110 in FIG. 1 according to example embodiments may include one or more switches 130 and 135 and an RGB-to-Y converter 140. In some example embodiments, as illustrated in FIG. 2A, the one or more switches 130 and 135 may operate in a normal mode to form a data path that does not pass through the RGB-to-Y converter 140. Thus, in the normal mode, the first data converting block 120 may receive first image data IDATA1, and may bypass (or output as it is) the first image data IDATA1. In some example embodiments, the first image data IDATA1 may be RGB data including red sub-pixel data R, green sub-pixel data G and blue sub-pixel data B, and the first data converting block 120 may output the RGB data as it is in the normal mode. For example, if the RGB data input to the first data converting block 120 have values of (25, 73, 25) with respect to a pixel, the first data converting block 120 may output the RGB data having the same values of (25, 73, 25) with respect to the pixel. Here, that the RGB data having the same values of (25, 73, 25) with respect to the pixel may mean that the RGB data includes R data having a value of 25 with respect to a red sub-pixel of the pixel, G data having a value of 73 with respect to a green sub-pixel of the pixel, and B data having a value of 25 with respect to a blue sub-pixel of the pixel.

Referring to FIG. 2B, in a low power mode, the one or more switches 130 and 135 may operate to form a data path that passes through the RGB-to-Y converter 140. The RGB-to-Y converter 140 may receive the first image data IDATA1 input to the first data converting block 120, and may convert the first image data IDATA1 into second image data IDATA2 having a reduced number of bits per pixel compared with the first image data IDATA1. Accordingly, in the low power mode, the first data converting block 120 may output the second image data IDATA2 having the reduced number of bits per pixel compared with the received first image data IDATA1.

In some example embodiments, the first image data DATA1 may be RGB data having 24 bits per pixel, the second image data IDATA2 may be luminance data Y having 8 bits per pixel, and the RGB-to-Y converter 140 may convert the RGB data having 24 bits per pixel into the luminance data Y having 8 bits per pixel. Further, in some example embodiments, the RGB-to-Y converter 140 may convert the RGB data into the luminance data Y using an equation "Y=0.25*R+0.5*G+0.25*B", where Y represents a value of the luminance data, R represents a value of red sub-pixel data of the RGB data, G represents a value of green sub-pixel data of the RGB data, and B represents a value of blue sub-pixel data of the RGB data. For example, if the RGB data input to the first data converting block 120 have values of (25, 73, 25) with respect to a pixel, the RGB-to-Y converter 140 may convert the RGB data having the values of (25, 73, 25) into the luminance data Y having a value of (Y)=(0.25*R+0.5*G+0.25*B)=(0.25*25+0.5*73+0.25*25)=(49) with respect to the pixel. In the low power mode, the RGB-to-Y converter 140 may convert the RGB data having 24 bits per pixel into the luminance data Y having 8 bits per pixel, and the host device 100 may transfer the luminance data Y instead of the RGB data to the display device 150, thereby reducing the interface power consumption between the host device 100 and the display device 150 in the low power mode.

Figure 3A:
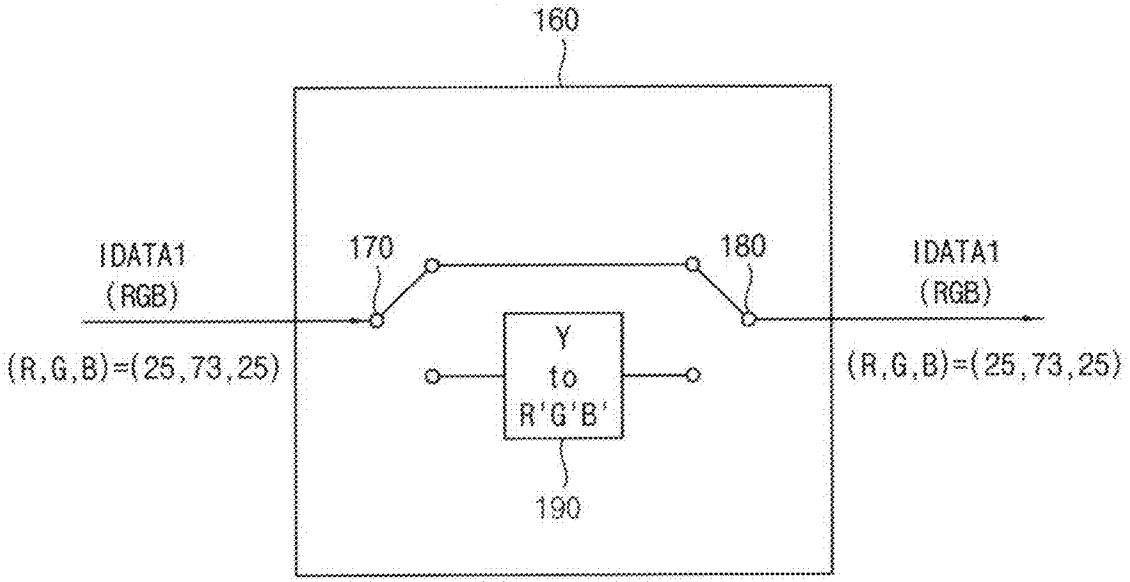
FIG. 3A is a diagram for describing an example of a normal mode operation of a data converting block included in a display device illustrated in FIG. 1.
Figure 3B:
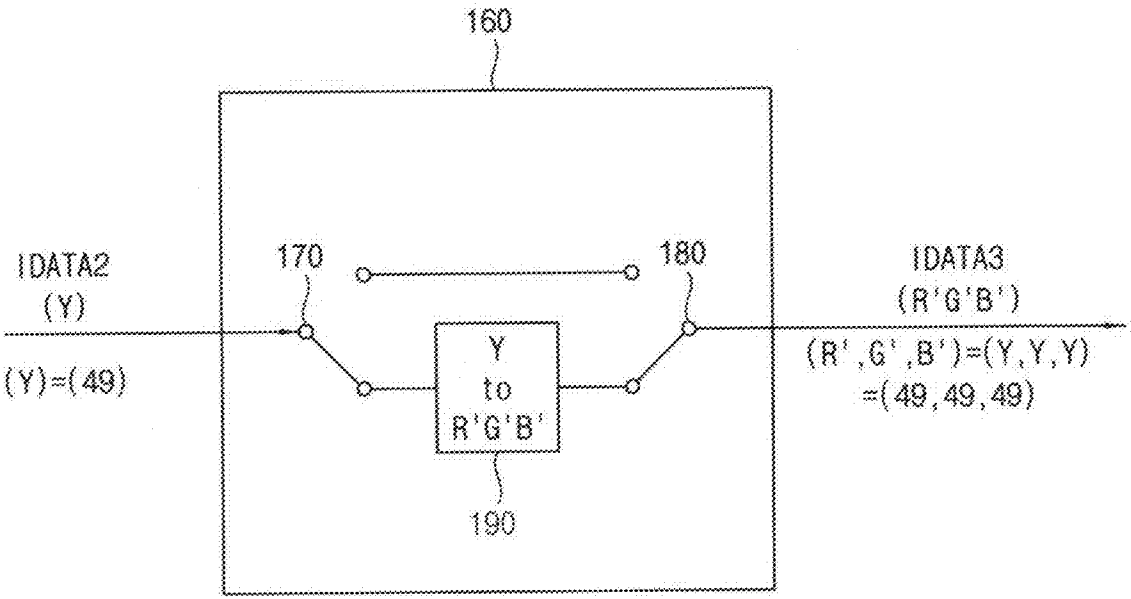
FIG. 3B is a diagram for describing an example of a low power mode operation of a data converting block included in a display device illustrated in FIG. 1.
Figure 4:
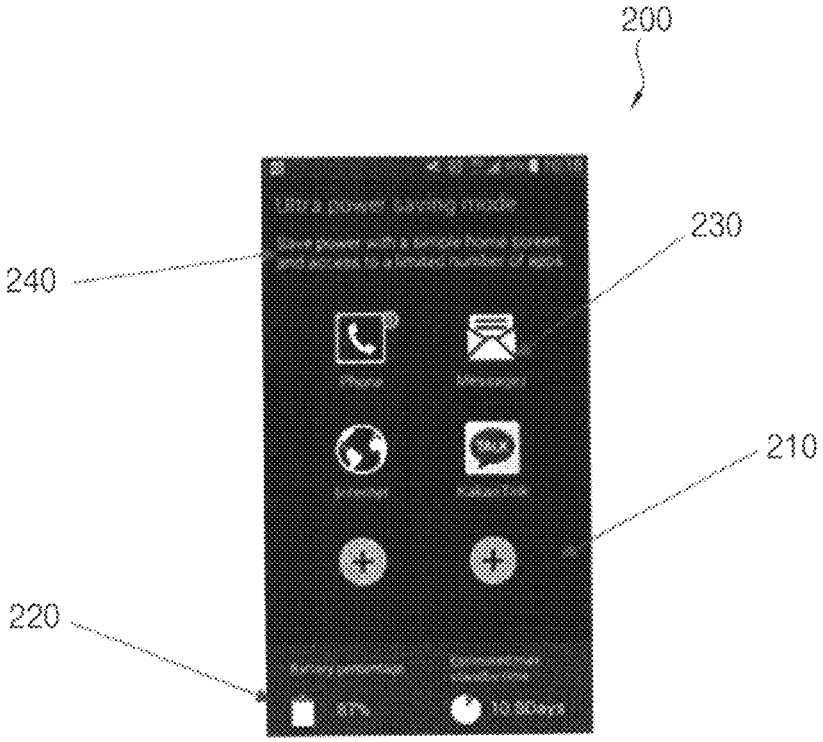
FIG. 4 is a diagram illustrating an example of an image displayed by a display device included in an electronic device according to example embodiments.

FIG. 3A is a diagram for describing an example of a normal mode operation of the second data converting block 160 included in the display device 150 illustrated in FIG. 1, FIG. 3B is a diagram for describing an example of a low power mode operation of the second data converting block 120 included in the display device 150 illustrated in FIG. 1, and FIG. 4 is a diagram illustrating an example of an image displayed by a display device included in an electronic device according to example embodiments.

Referring to FIG. 3A, the second data converting block 160 included in the display device 150 in FIG. 1 according to example embodiments may include one or more switches 170 and 180 and a Y-to-R'G'B' converter 190. In some example embodiments, as illustrated in FIG. 3A, the one or more switches 170 and 180 may operate in a normal mode to form a data path that does not pass through the Y-to-R'G'B' converter 190. Thus, in the normal mode, the second data converting block 160 may bypass (or output as it is) first image data IDATA1 (e.g., RGB data) that are received. For example, if the RGB data input to the second data converting block 160 have values of (25, 73, 25) with respect to a pixel, the second data converting block 160 may output the RGB data having the same values of (25, 73, 25) with respect to the pixel. The RGB data output from the second data converting block 160 may be provided to a timing controller of the display device 150, and the timing controller may control the display device 150 to display a color image based on the RGB data.

Referring to FIG. 3B, in a low power mode, the one or more switches 170 and 180 may operate to form a data path that passes through the Y-to-R'G'B' converter 190. In the low power mode, the Y-to-R'G'B' converter 190 may convert second image data IDATA2 (e.g., luminance data Y) input to the second data converting block 160 of the display device 510 into third image data IDATA3 (e.g., black-and-white data R'G'B'). In some example embodiments, the Y-to-R'G'B' converter 190 may convert the luminance data Y into the black-and-white data R'G'B' including red sub-pixel data R', green sub-pixel data G' and blue sub-pixel data B' each having a value the same as a value of the luminance data Y with respect to each pixel. For example, the Y-to-R'G'B' converter 190 may convert the luminance data Y having a value of (49) with respect to a pixel into the black-and-white data R'G'B' having values of (R', G', B')=(Y, Y, Y)=(49, 49, 49) with respect to the pixel.

The black-and-white data R'G'B' output from the second data converting block 160 may be provided to the timing controller of the display device 150, and the timing controller may control the display device 150 to display a black-and-white image based on the black-and-white data R'G'B'. As illustrated in FIG. 4, the image displayed by the display device 150 in the low power mode may be a black-and-white image 200. For example, the black-and-white image 200 in the low power mode may include a first background image 210 displayed based on the black-and-white data R'G'B' having values of (0, 0, 0) for each pixel, a second background image 220 displayed based on the black-and-white data R'G'B' having values of (24, 24, 24) for each pixel, an icon image 230 displayed based on the black-and-white data R'G'B' having values of (179, 179, 179) for each pixel, and a text image 240 displayed based on the black-and-white data R'G'B' having values of (190, 190, 190) for each pixel. However, the black-and-white image 200 illustrated in FIG. 4 is only an example, and example embodiments are not limited to the example illustrated in FIG. 4.

Figure 5:
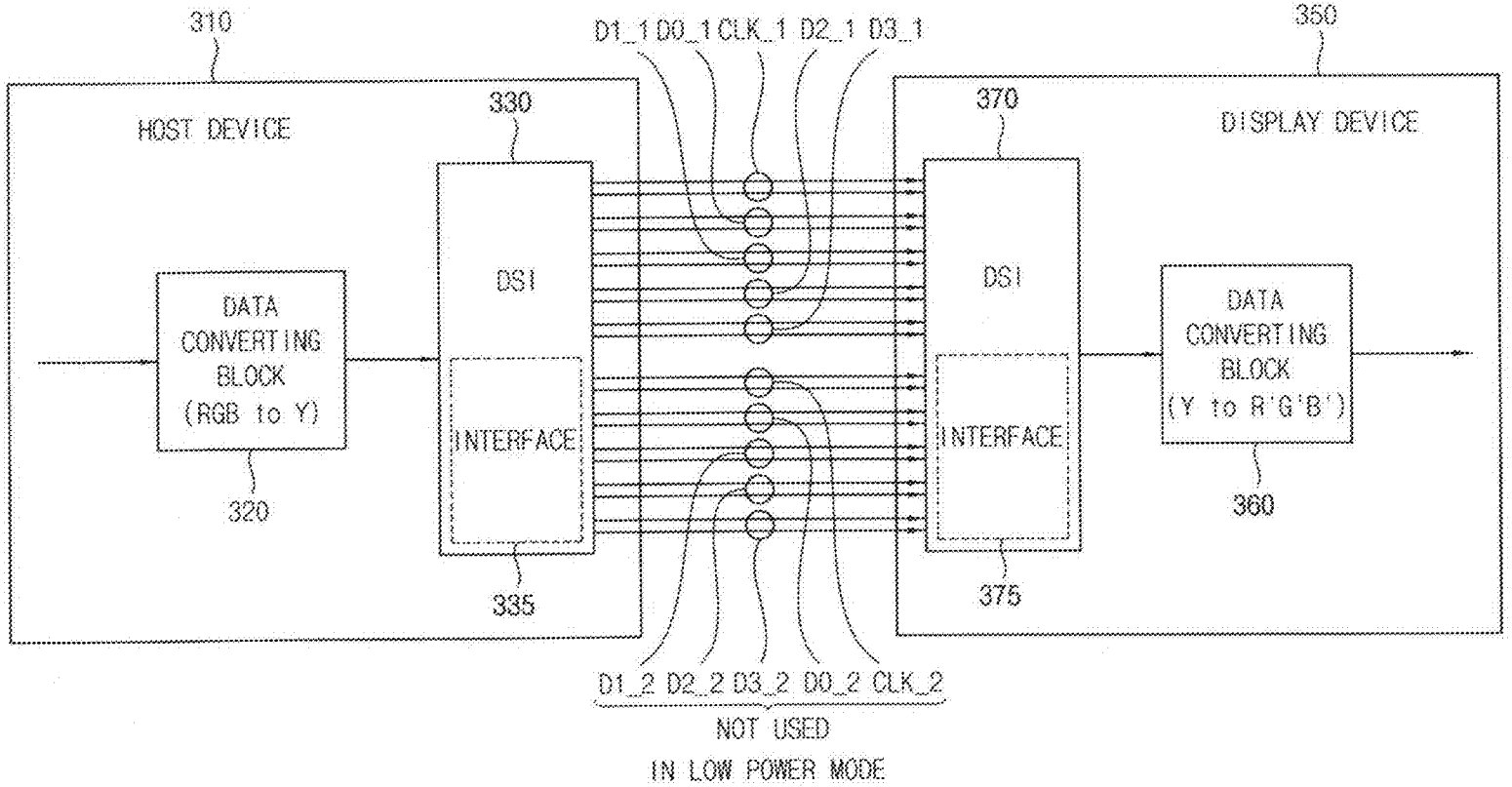
FIG. 5 is a block diagram illustrating an electronic device including a host device and a display device according to example embodiments.

FIG. 5 is a block diagram illustrating an electronic device 300 including a host device 310 and a display device 350 according to example embodiments.

Referring to FIG. 5, the electronic device 300 according to example embodiments may include the host device 310, the display device 350, and a plurality of data lanes D0_1, D1_1, D2_1, D3_1, D0_2, D1_2, D2_2 and D3_2 between the host device 310 and the display device 350. The host device 310 may include a first data converting block 320 and a first interface block (e.g., a display serial interface (DSI) interface block) 330, and the display device 350 may include a second data converting block 360 and a second interface block (e.g., a DSI interface block) 370. The electronic device 300 of FIG. 5 may have similar configurations and operations to the electronic device 100 of FIG. 1, except that image data are transferred through the plurality of data lanes D0_1, D1_1, D2_1, D3_1, D0_2, D1_2, D2_2 and D3_2 between the host device 310 and the display device 350.

In a normal mode, the first data converting block 320 of the host device 310 may bypass first image data, and the first interface block 330 of the host device 310 may transfer the first image data to the display device 350 through the plurality of data lanes D0_1, D1_1, D2_1, D3_1, D0_2, D1_2, D2_2 and D3_2. Further, the first interface block 330 may transfer clock signals through one or more clock lanes CLK_1 and CLK_2. The second interface block 370 of the display device 350 may receive the first image data from the host device 310 through the plurality of data lanes D0_1, D1_1, D2_1, D3_1, D0_2, D1_2, D2_2 and D3_2, and the second data converting block 360 of the display device 350 may bypass the first image data received via the second interface block 370. In the normal mode, the display device 350 may display a first image (e.g., a color image) based on the first image data (e.g., RGB data).

In a low power mode, the first data converting block 320 of the host device 310 may convert the first image data (e.g., the RGB data) having a first number of bits per pixel into second image data (e.g., luminance data) having a second number of bits per pixel less than the first number of bits per pixel. The first interface block 330 of the host device 310 may transfer the second image data (e.g., the luminance data) to the display device 350 through only a portion D0_1, D1_1, D2_1 and D3_1 of the plurality of data lanes D0_1, D1_1, D2_1, D3_1, D0_2, D1_2, D2_2 and D3_2. Further, the first interface block 330 may transfer a clock signal through a portion CLK_1 of the one or more clock lanes CLK_1 and CLK_2. Since the second image data having the second number of bits per pixel less than the first number of bits per pixel of the first image data are transferred in the low power mode, a data transfer amount from the host device 310 to the display device 350 may be reduced, and thus the second image data may be properly transferred within a desired time even if only the portion D0_1, D1_1, D2_1 and D3_1 of the plurality of data lanes D0_1, D1_1, D2_1, D3_1, D0_2, D1_2, D2_2 and D3_2 is used.

The second interface block 370 of the display device 350 may receive the second image data from the host device 310 through the portion D0_1, D1_1, D2_1 and D3_1 of the plurality of data lanes D0_1, D1_1, D2_1, D3_1, D0_2, D1_2, D2_2 and D3_2, and the second data converting block 360 of the display device 350 may convert the second image data (e.g., the luminance data) received via the second interface block 370 into third image data (e.g., black-and-white data). In the low power mode, the display device 350 may display a second image (e.g., a black-and-white image) based on the third image data (e.g., the black-and-white data).

In some example embodiments, as illustrated in FIG. 5, the first image data may be transferred from the host device 310 to the display device 350 using a dual display serial interface (dual DSI) in the normal mode, and the second image data may be transferred from the host device 310 to the display device 350 using a single display serial interface (single DSI) in the low power mode. Thus, in the low power mode, the portion D0_1, D1_1, D2_1 and D3_1 of the plurality of data lanes D0_1, D1_1, D2_1, D3_1, D0_2, D1_2, D2_2 and D3_2 may be used, and the remaining portion D0_2, D1_2, D2_2 and D3_2 of the plurality of data lanes D0_1, D1_1, D2_1, D3_1, D0_2, D1_2, D2_2 and D3_2 may not be used. Further, in this case, supplying power to the remaining portion D0_2, D1_2, D2_2 and D3_2 of the plurality of data lanes D0_1, D1_1, D2_1, D3_1, D0_2, D1_2, D2_2 and D3_2 through which the second image data are not transferred may be stopped during the low power mode. For example, a portion 335 of the first interface block 330 associated with (or connected to) the data lines D0_2, D1_2, D2_2 and D3_2 that are not used in the low power mode may not be supplied with power during the low power mode, and a portion 375 of the second interface block 370 associated with (or connected to) the data lines D0_2, D1_2, D2_2 and D3_2 that are not used in the low power mode may not be supplied with power during the low power mode. Accordingly, the interface power consumption between the host device 310 and the display device 350 in the low power mode may be further reduced.

Figure 6:
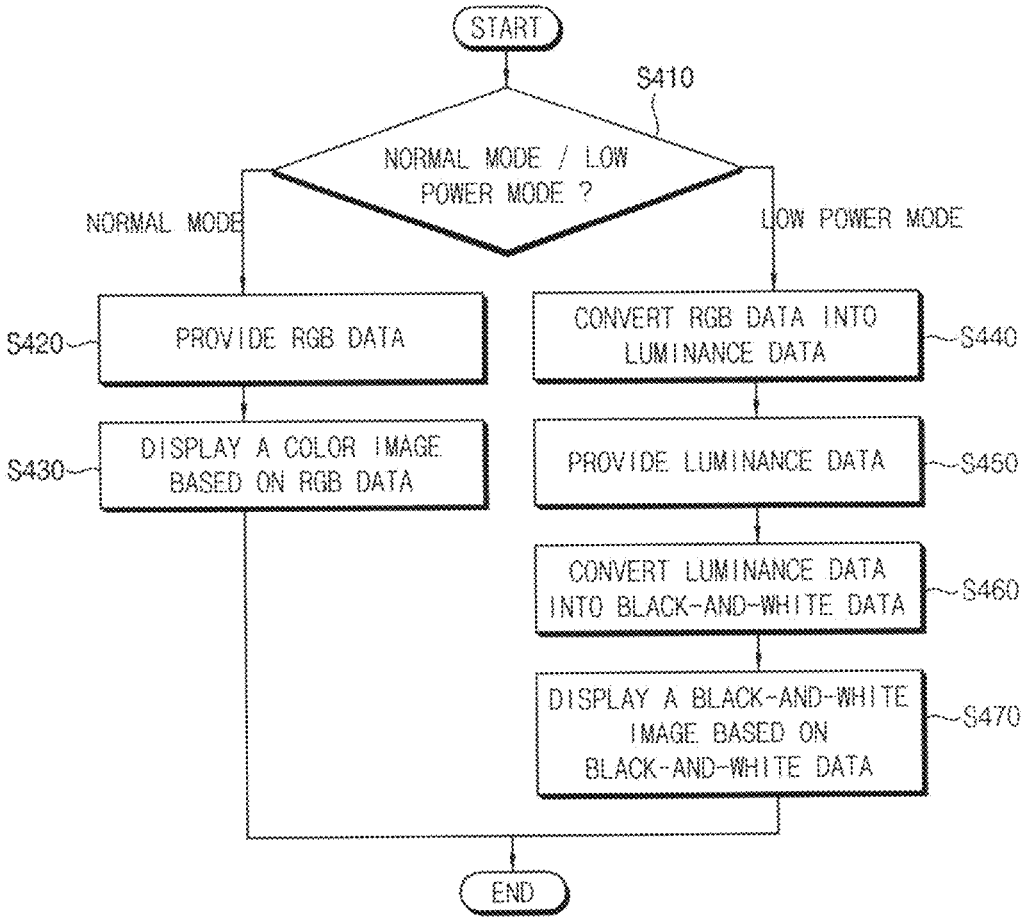
FIG. 6 is a flowchart illustrating a method of operating an electronic device including a host device and a display device according to example embodiments.

FIG. 6 is a flowchart illustrating a method of operating an electronic device including a host device and a display device according to example embodiments.

Referring to FIG. 6, in an electronic device including a host device and a display device, the host device may provide the display device with first image data having a first number of bits per pixel in a normal mode (operation S410: NORMAL MODE, and operation S420). The display device may display a first image (e.g., a color image) based on the first image data (e.g., RGB data) in the normal mode (operation S430).

The host device may convert the first image data (e.g., the RGB data) into second image data (e.g., luminance data) having a second number of bits per pixel less than the first number of bits per pixel in a low power mode (operation S410: LOW POWER MODE, operation S440). In some example embodiments, the second number of bits per pixel of the second image data may be about one third of the first number of bits per pixel of the first image data. The host device may provide the display device with the second image data (operation S450). In some example embodiments, the first image data may be transferred through a plurality of data lanes between the host device and the display device in the normal mode, and the second image data may be transferred through a portion of the plurality of data lanes in the low power mode.

The display device may convert the second image data (e.g., the luminance data) into third image data (e.g., black-and-white data) in the low power mode (operation S460). In some example embodiments, the third image data may be the black-and-white data including red sub-pixel data, green sub-pixel data and blue sub-pixel data each having a value the same as a value of the second image data (e.g., the luminance data) with respect to each pixel. The display device may display a second image (e.g., a black-and-white image) based on the third image data (e.g., the black-and-white data) (operation S470).

As described above, in the method of operating the electronic device, the host device may transfer, in the low power mode, the second image data (e.g., the luminance data) having the second number of bits per pixel less than the first number of bits per pixel of the first image data transferred in the normal mode to the display device, and thus the interface power consumption between the host device and the display device in the low power mode may be reduced.

Figure 7:
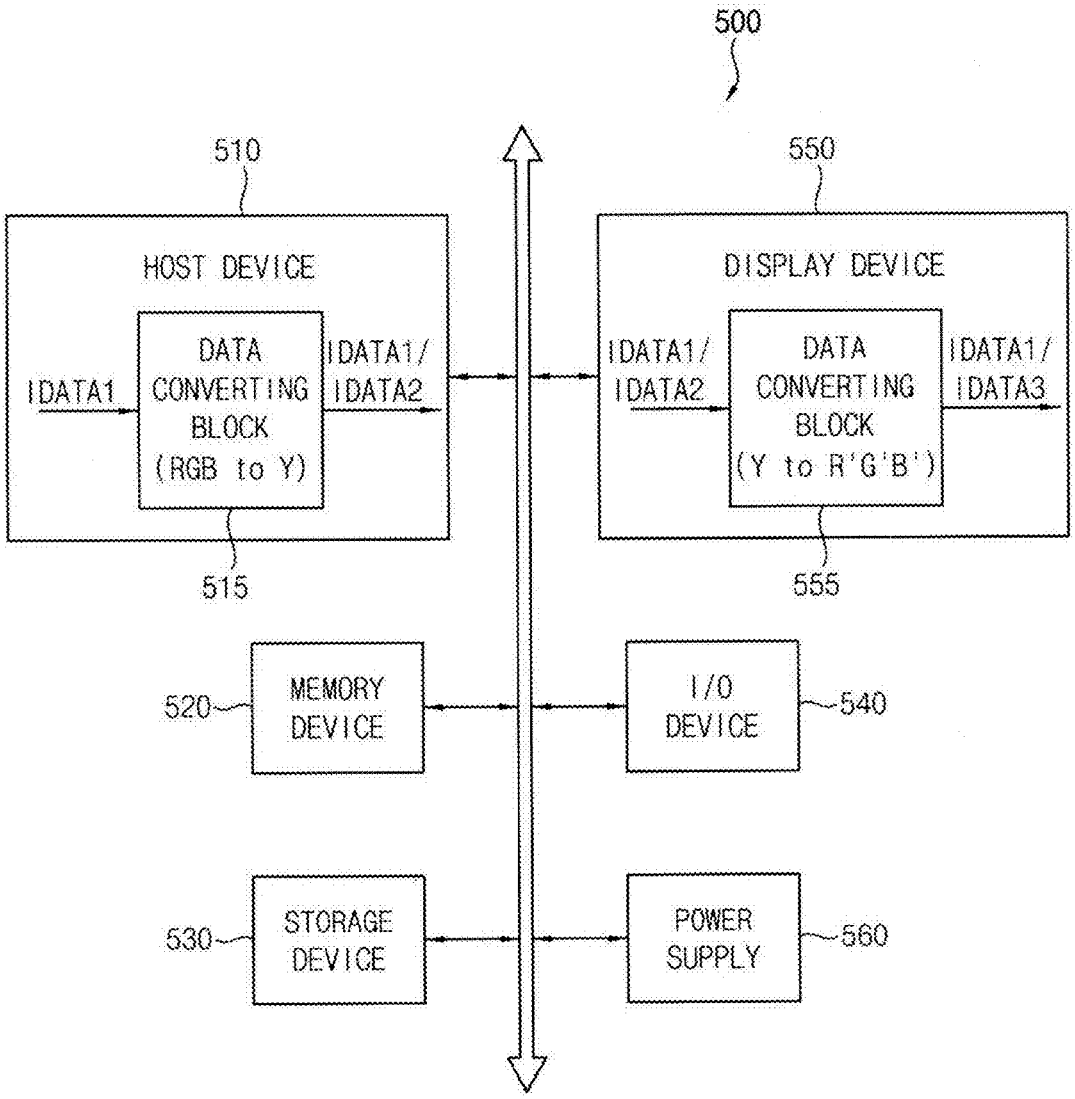
FIG. 7 is a block diagram illustrating an example of an electronic device according to example embodiments.

FIG. 7 is a block diagram illustrating an example of an electronic device 500 according to example embodiments.

Referring to FIG. 7, the electronic device 500 may include a host device 510, a memory device 520, a storage device 530, an input/output (I/O) device 540, a display device 550, and a power supply 560. The electronic device 500 may further include a plurality of ports for communicating with a video card, a sound card, a memory card, a universal serial bus (USB) device, other electronic devices, etc.

The host device 510 may perform various computing functions or tasks. In some example embodiments, the host device 510 may be an application processor (AP). In other example embodiments, the host device 510 may be a central processing unit (CPU), a graphics processing unit (GPU), a micro processor, etc. The host device 510 may be coupled to other components via an address bus, a control bus, a data bus, etc. Further, the host device 510 may be coupled to an extended bus such as a peripheral component interconnection (PCI) bus. In some example embodiments, the host device 510 may include a first data converting block 515 that bypasses first image data IDATA1 in a normal mode and converts the first image data IDATA1 into second image data IDATA2 having a reduced number of bits per pixel compared with the first image data IDATA1 in a low power mode.

The display device 550 may display an image. In some example embodiments, the display device 550 may be an organic light emitting diode (OLED) display device. In other example embodiments, the display device 550 may be a liquid crystal display (LCD) device, or the like. In some example embodiments, the display device 550 may include a second data converting block 555 that bypasses the first image data IDATA1 in the normal mode and converts the second image data IDATA2 into third image data IDATA3 in the low power mode. Since the host device 510 transfers, in the low power mode, the second image data IDATA2 having the reduced number of bits per pixel compared with the first image data IDATA1 to the display device 550, the interface power consumption between the host device 510 and the display device 550 in the low power mode may be reduced.

The memory device 520 may store data for operations of the electronic device 500. For example, the memory device 520 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc.

The storage device 530 may be a solid state drive (SSD) device, a hard disk drive (HDD) device, a CD-ROM device, etc. The I/O device 540 may be an input device such as a keyboard, a keypad, a mouse device, a touchpad, a touchscreen, a remote controller, etc, and an output device such as a printer, a speaker, etc. The power supply 560 may provide power for operations of the electronic device 500.

In some example embodiments, the electronic device 500 may be a portable electronic device, such as a smart phone, a mobile phone, a tablet computer, etc. In other example embodiments, the electronic device 500 may be any electronic device including the display device 550, such as a digital television (TV), a 3D TV, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the novel teachings of the present inventive concept. Accordingly, all such modifications are intended to be included within the scope of the present inventive concept as defined in the claims. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. An electronic device comprising:

a host device configured to provide a display device with first image data having a first number of bits per pixel in a normal mode, and to convert the first image data into second image data having a second number of bits per pixel less than the first number of bits per pixel to provide the display device with the second image data in a low power mode;

the display device configured to display a first image based on the first image data in the normal mode, and to convert the second image data into third image data to display a second image based on the third image data in the low power mode; and a plurality of data lanes located between the host device and the display device, the plurality of data lanes being used to transfer the first image data and the second image data.

2. The electronic device of claim 1, wherein the host device comprises:

a first data converting block configured to bypass the first image data in the normal mode, and to convert the first image data into the second image data in the low power mode.

3. The electronic device of claim 2, wherein the first data converting block converts RGB data as the first image data into luminance data as the second image data in the low power mode.

4. The electronic device of claim 3, wherein the first data converting block converts the RGB data into the luminance data using an equation "Y =0.25*R +0.5*G +0.25*B", where Y represents a value of the luminance data, R represents a value of red sub-pixel data of the RGB data, G represents a value of green sub-pixel data of the RGB data, and B represents a value of blue sub-pixel data of the RGB data.

5. The electronic device of claim 1, wherein the second number of bits per pixel of the second image data is one third of the first number of bits per pixel of the first image data.

6. The electronic device of claim 1, wherein the display device comprises:

a second data converting block configured to bypass the first image data in the normal mode, and to convert the second image data into the third image data in the low power mode.

7. The electronic device of claim 6, wherein the second data converting block converts luminance data as the second image data into black-and-white data as the third image data in the low power mode.

8. The electronic device of claim 7, wherein the black-and-white data includes red sub-pixel data, green sub-pixel data and blue sub-pixel data each having a value the same as a value of the luminance data with respect to each pixel.

9. The electronic device of claim 1, wherein the display device displays a color image as the first image in the normal mode, and displays a black-and-white image as the second image in the low power mode.

10. The electronic device of claim 1, wherein the first image data are transferred through the plurality of data lanes in the normal mode, and wherein the second image data are transferred through a portion of the plurality of data lanes in the low power mode.

11. The electronic device of claim 10, wherein supplying power to a remaining portion of the plurality of data lanes through which the second image data are not transferred is stopped during the low power mode.

12. An electronic device comprising:

a host device configured to provide a display device with first image data having a first number of bits per pixel in a normal mode, and to convert the first image data into second image data having a second number of bits per pixel less than the first number of bits per pixel to provide the display device with the second image data in a low power mode; and the display device configured to display a first image based on the first image data in the normal mode, and to convert the second image data into third image data to display a second image based on the third image data in the low power mode, wherein the first image data are transferred from the host device to the display device using a dual display serial interface in the normal mode, and wherein the second image data are transferred from the host device to the display device using a single display serial interface in the low power mode.

13. A method of operating an electronic device including a host device and a display device, the method comprising:

providing, by the host device, the display device with first image data having a first number of bits per pixel in a normal mode;

providing, by the host device, the display device with second image data having a second number of bits per pixel less than the first number of bits per pixel in a low power mode by converting the first image data into the second image data;

displaying, by the display device, a first image based on the first image data in the normal mode; and displaying, by the display device, a second image based on third image data in the low power mode by converting the second image data into the third image data, wherein the first image data are transferred through a plurality of data lanes between the host device and the display device in the normal mode, and wherein the second image data are transferred through a portion of the plurality of data lanes in the low power mode.

14. The method of claim 13, wherein the first image data are RGB data, and the second image data are luminance data.

15. The method of claim 13, wherein the second number of bits per pixel of the second image data is one third of the first number of bits per pixel of the first image data.

16. The method of claim 13, wherein the third image data are black-and-white data including red sub-pixel data, green sub-pixel data and blue sub-pixel data each having a value the same as a value of the second image data with respect to each pixel.

17. The method of claim 13, wherein the first image is a color image, and the second image is a black-and-white image.

* * * * *